US008251247B1

(12) United States Patent
Breckner

(10) Patent No.: US 8,251,247 B1
(45) Date of Patent: Aug. 28, 2012

(54) THERMAL HOLDER FOR CONTAINER

(76) Inventor: Jason J. Breckner, Prior Lake, MN (US)

( * ) Notice: Subject to any disclaimer, the term of this patent is extended or adjusted under 35 U.S.C. 154(b) by 388 days.

(21) Appl. No.: 12/592,959

(22) Filed: Dec. 7, 2009

Related U.S. Application Data

(60) Provisional application No. 61/216,918, filed on May 26, 2009.

(51) Int. Cl.
*B65D 25/00* (2006.01)
*F25D 23/00* (2006.01)
*A47G 1/17* (2006.01)

(52) U.S. Cl. ..... 220/739; 220/592.16; 248/309.4

(58) Field of Classification Search ..... 220/739, 220/592.16, 592.17, 703, 495.03, 62.12, 220/903; 248/309.4, 206.5, 683; 215/395, 215/386, 13.1, 12.1; 62/457.4
See application file for complete search history.

(56) References Cited

U.S. PATENT DOCUMENTS

| | | | | | |
|---|---|---|---|---|---|
| 3,302,427 | A * | 2/1967 | Schneider et al. | ..... | 62/457.4 |
| 3,524,614 | A * | 8/1970 | Sorth | ..... | 248/131 |
| 3,556,341 | A | 1/1971 | Rains | | |
| 3,633,863 | A * | 1/1972 | Abbey | ..... | 248/346.11 |
| 4,183,226 | A * | 1/1980 | Moore | ..... | 62/457.4 |
| 4,671,424 | A * | 6/1987 | Byrns | ..... | 220/592.16 |
| 5,186,350 | A * | 2/1993 | McBride | ..... | 220/739 |
| 5,873,486 | A * | 2/1999 | Morgan | ..... | 220/739 |
| 6,065,632 | A | 5/2000 | Moore, Jr. | | |
| 6,141,696 | A * | 10/2000 | Goertzel et al. | ..... | 719/310 |
| 6,305,656 | B1 * | 10/2001 | Wemyss | ..... | 248/309.4 |
| 2002/0145090 | A1 * | 10/2002 | Schenk, Jr. | ..... | 248/206.5 |
| 2005/0056655 | A1 * | 3/2005 | Gary | ..... | 220/737 |

* cited by examiner

*Primary Examiner* — Bryon Gehman
*Assistant Examiner* — Shawn Braden
(74) *Attorney, Agent, or Firm* — Richard John Bartz

(57) ABSTRACT

A thermal insulated holder for a beverage can or bottle has a metal body accommodating a cylindrical core. A base having magnetic properties has a permanent ring magnet attached to a cup-shaped ferrous metal member.

20 Claims, 6 Drawing Sheets

THERMAL HOLDER FOR CONTAINER

CROSS REFERENCE TO RELATED APPLICATION

This application claims the priority of U.S. Provisional Patent Application Ser. No. 61/216,918 filed May 26, 2009.

The invention relates to a container holder having a magnet to retain the holder on a ferrous metal support. The holder has a metal body surrounding an insulation core for accommodating a beverage can or bottle. A magnet assembly located within the bottom of the body magnetically retains the holder on a ferrous metal support.

BACKGROUND OF THE INVENTION

Foam plastic sleeves adapted to fit around a beverage can or bottle are used to insulate the can or bottle to keep the beverage therein cool. Beverage can holders have been provided with permanent magnets to stabilize the holders on an underlying support surface. The magnets have been disposed between inner and outer walls of the holders and embedded in the walls of the holder during manufacture of the holders. This is a costly and labor intensive manufacturing process that requires complex and expensive molding equipment. Examples of holders having magnets are disclosed in the following U.S. Patents and U.S. Patent Publications.

F. D. Rains in U.S. Pat. No. 3,556,341 a drinking container having magnets mounted in the bottom wall and the side wall to permit attachment of the container to a ferrous metal surface.

G. S. Moore Jr. in U.S. Pat. No. 6,065,632 describes and shows a container for beverages having a magnetic base for stabilizing the container on a metallic surface. The container has concentric plastic outer and inner side and bottom walls. A circular magnet located between the bottom walls is held in position with a post extended upwardly from the outer bottom wall.

R. D. Wemyss discloses in U.S. Pat. No. 6,305,656 a magnetic coupler adapted to be secured to a support. A beverage cup holder has a ferrous disk secured to the bottom wall of the holder. The cup holder is located over the magnetic coupler whereby magnetic force retains the cup holder in an upright position on the support.

L. F. Gary in U.S. Patent Application Publication No. 2005/0056655 discloses a beverage can or bottle holder having a thermally insulative side and bottom walls. Magnets are embedded in the side and bottom walls. the magnets have sufficient attractive force to support the holder and beverage can or bottle on a ferrous metal surface.

DESCRIPTION OF THE INVENTION

Figure 1:
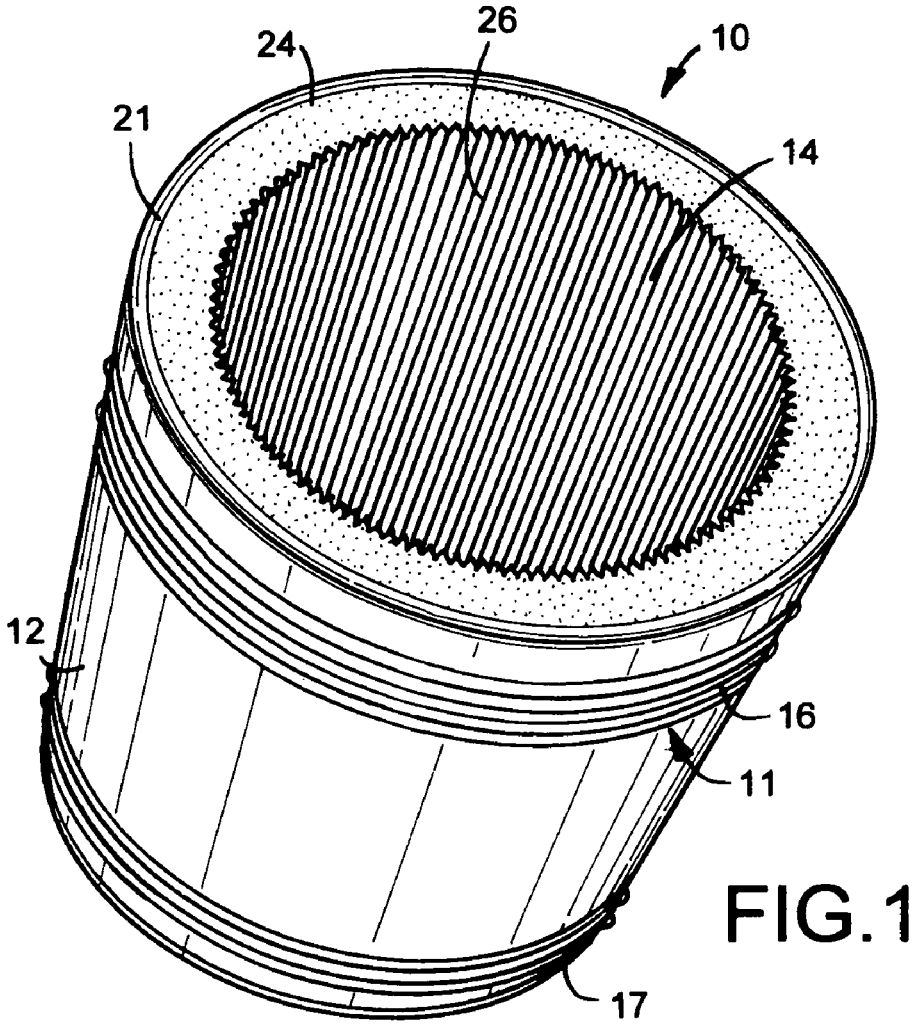
FIG. 1 is a perspective view of a thermal insulated holder for a container of the invention.
Figure 2:
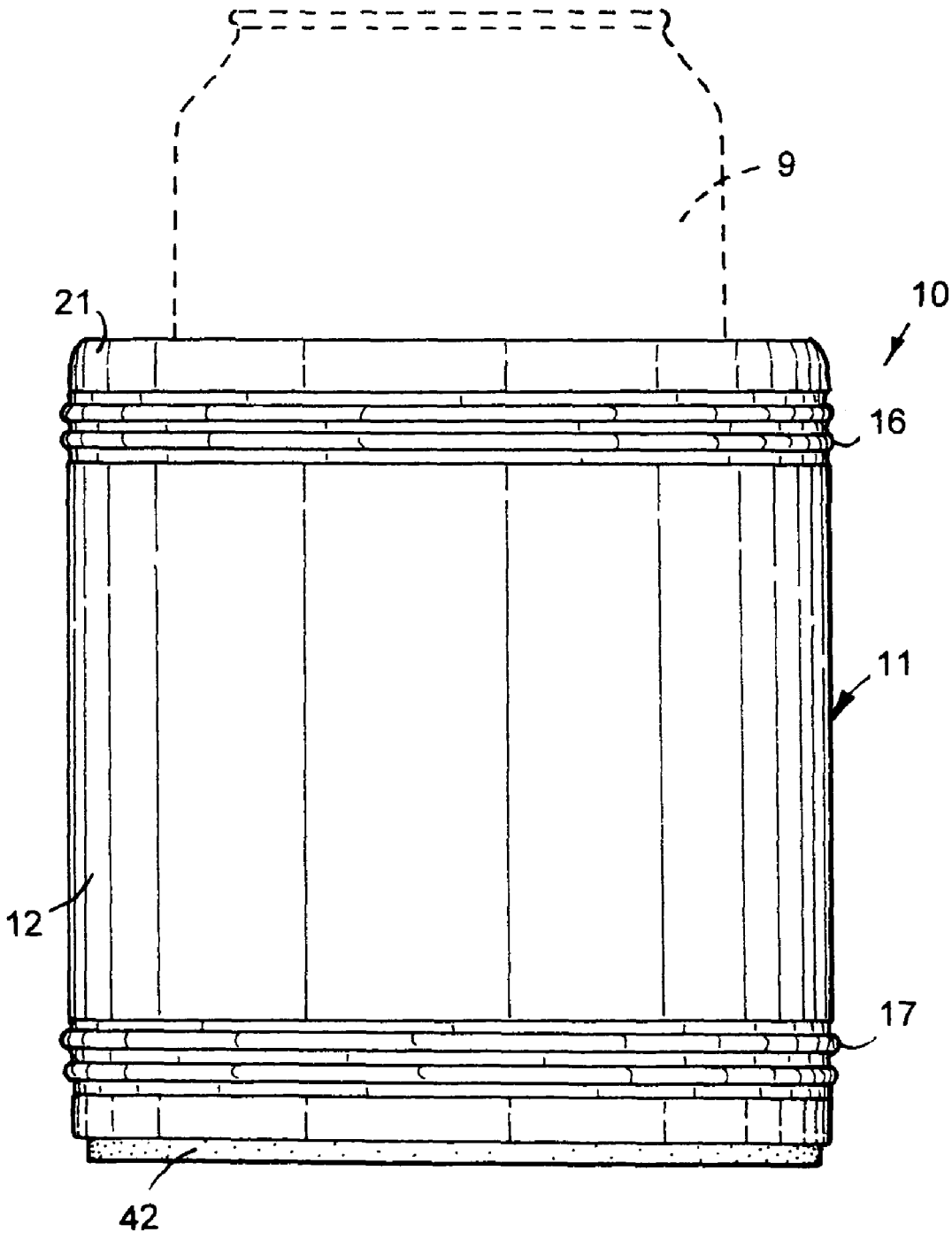
FIG. 2 is a front elevational view thereof.
Figure 3:
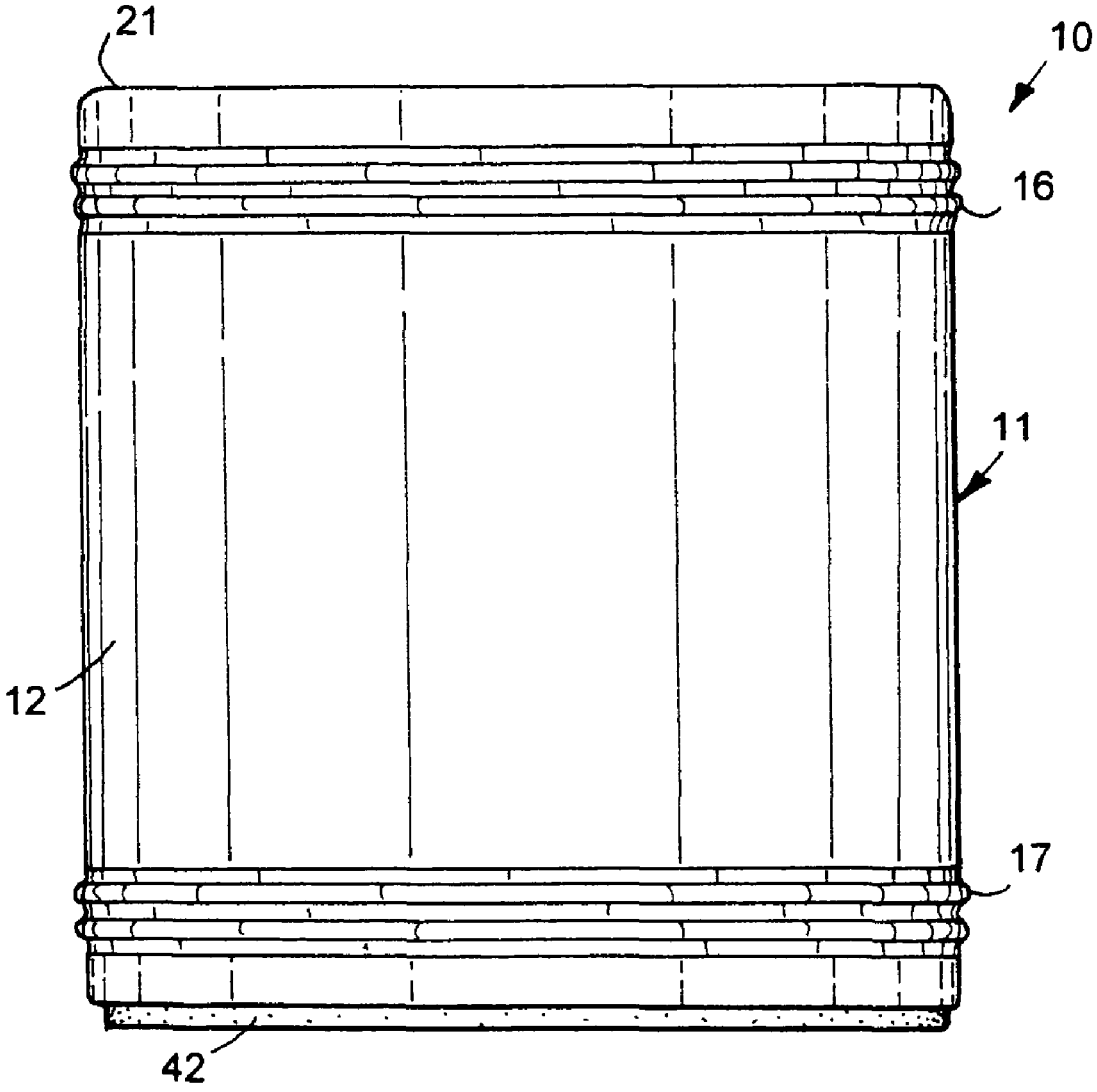
FIG. 3 is a side elevational view thereof.
Figure 5:
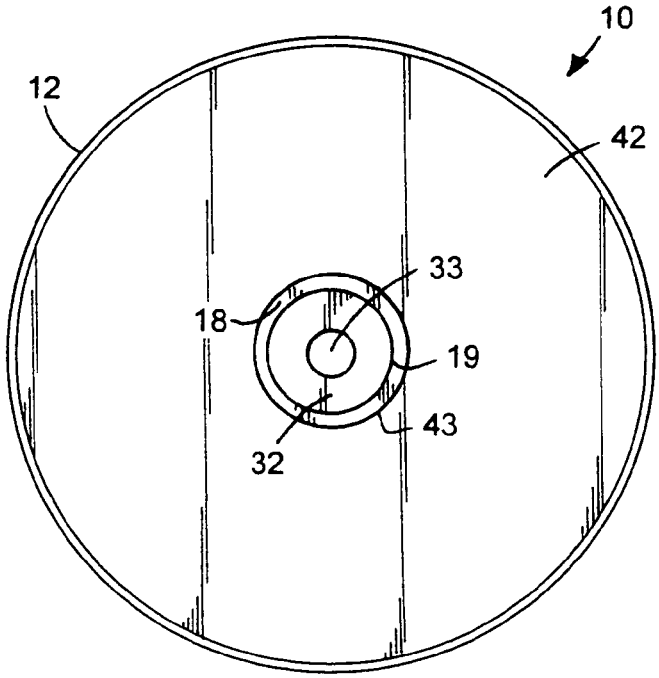
FIG. 5 is a bottom plan view thereof.
Figure 6:
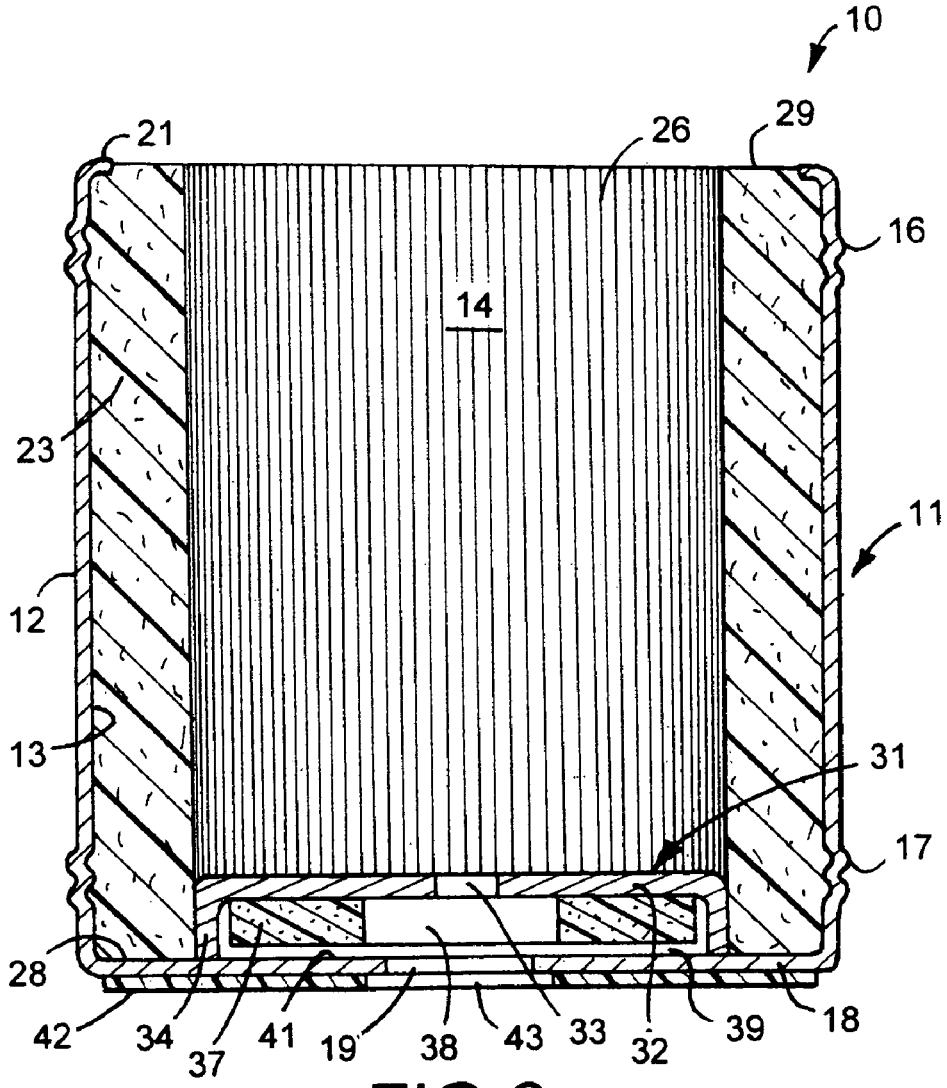
FIG. 6 is a sectional view taken along the line 6-6 of FIG. 4.
Figure 7:
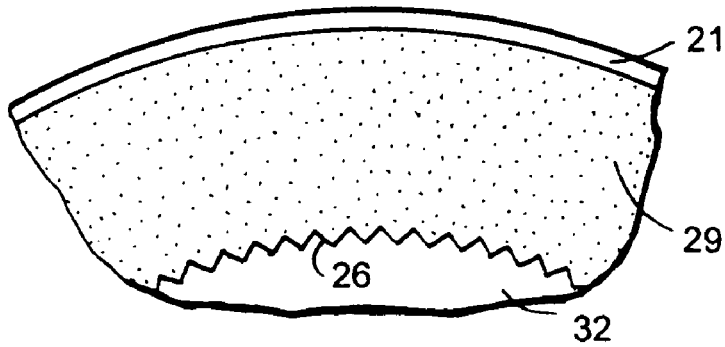
FIG. 7 is an enlarged section of the top plan view thereof.

A thermal insulated holder 10 for a container 9, such as a metal can or bottle, shown in FIGS. 1 to 3, have cup-shaped cylindrical body 11 with an open top. Body 11 is a rigid stainless steel member having a cylindrical outside wall 12 and a cylindrical inside wall 13 surrounding an inside chamber 14. The upper section of wall 12 has a plurality of continuous annular ribs 16. Additional continuous annular ribs 17 are formed into the lower section of wall 12. Ribs 16 and 17 increase the strength of wall 12 and provide gripping surfaces to facilitate hand gripping of holder 10. As shown in FIG. 5, holder 10 has a circular bottom wall 18 with a center hole 19. The top end of wall 12, as shown in FIG. 6, has an inwardly turned shoulder 21. Body 11 can be a plastic or ceramic member having cylindrical or other shapes.

A cylindrical core 23 or closed cell foam plastic is located in chamber 14. Core 23 is a cylindrical sleeve having an outer surface pressed into surface contact with the inside wall 13 of body 11. The outer top edge of core 23 is located under shoulder 21 whereby shoulder 21 inhibits axial shifting of core 23 relative to body 11. Returning to FIG. 6, the circular bottom 28 of core 23 is in surface contact with bottom wall 18 of body 11. The top circular force 29 of core 23 is coextensive with shoulder 21. The inside surface of core 23 has circumferentially spaced vertical ribs 26. The ribs 26 are radial flexible projections that provide vertical air channels adjacent the outside of a can or bottle positioned within core 23. The air channels provide air insulation and facilitate the insertion and removal of the can or bottle from core 23.

Figure 4:
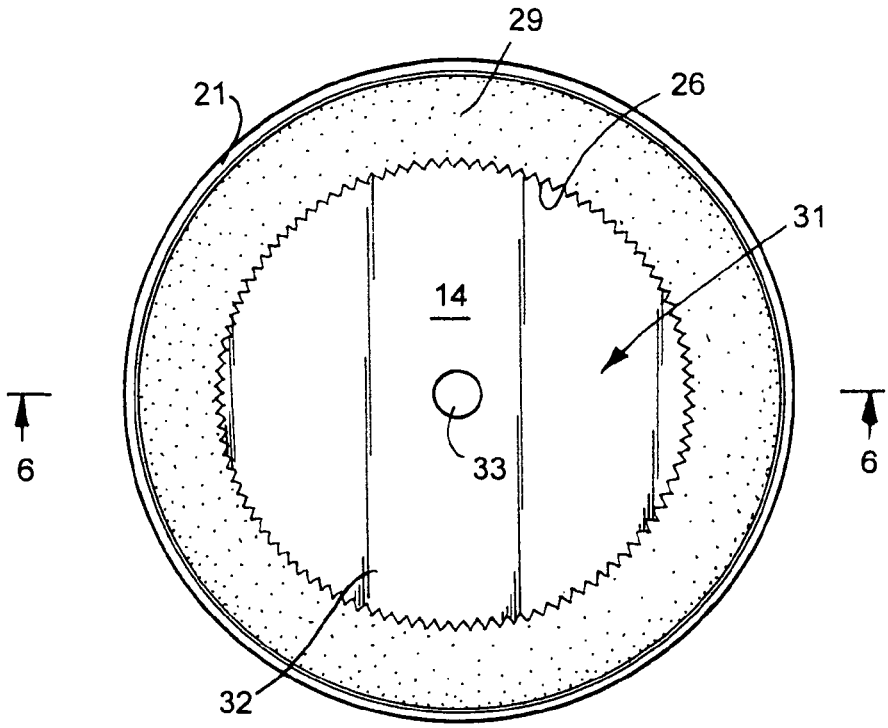
FIG. 4 is a top plan view thereof.
Figure 8:
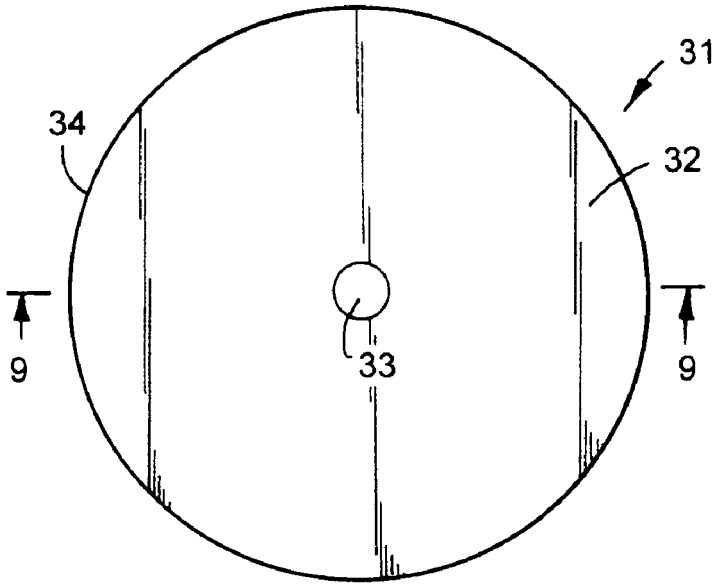
FIG. 8 is a top plan view of the magnet assembly for the holder of FIG. 1.
Figure 9:
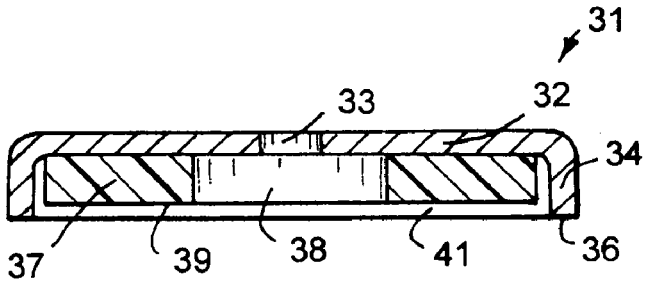
FIG. 9 is a sectional view taken along line 9-9 of FIG. 8.
Figure 10:
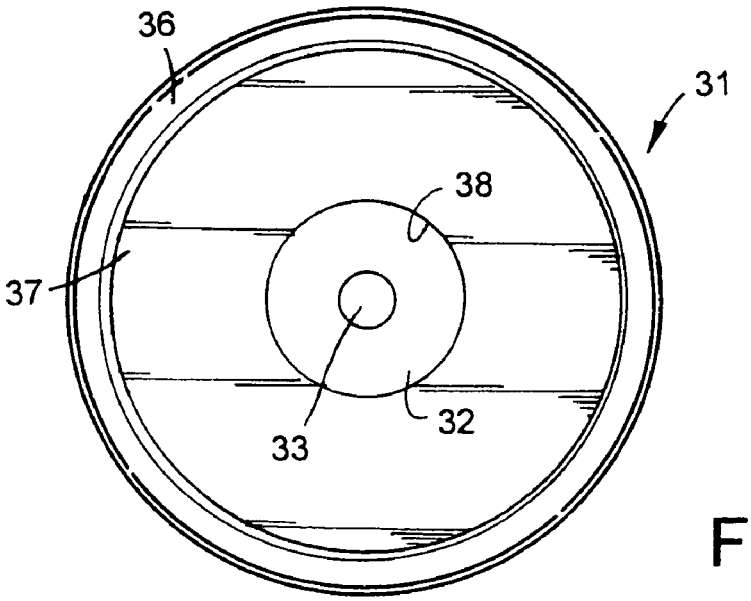
FIG. 10 is a bottom plan view of the magnet assembly of FIG. 8.

As shown in FIGS. 4 and 6, a circular base 31 having magnetic properties is positioned in the bottom of chamber 14. An adhesive can be used to attach base 31 to bottom wall 18 of body 11. Base 31 includes a ferrous metal disk 32 having a circular top wall with a center hole 33 and an annular side flange or wall 34. The lower circular end 36 of flange 34 is in surface contact with bottom wall 18 of body 11. As shown in FIGS. 8, 9 and 10, an annular flat ring magnet 37 is secured to the inside surface of top wall of disk 32. The lower surface of magnet 37 is spaced above bottom wall 18 of body. Space 41 separates magnet 37 from wall 18 whereby magnet flux forces are concentrated at the circular end 36 of flange 34. Magnet 37 is a permanent magnet, such as a neodymium ring magnet. Other types of permanent magnets can be used in base 31. Magnet 37 has a center hold 38 to allow air to flow through hole 19 in bottom wall 18 when a can or bottle is inserted into chamber 14 and withdrawn from chamber 14. In use, magnet 37 retains holder 10 in an upright position on a ferrous metal support. The magnetic flux forces concentrated at the circular end 36 of flange 34 of base 31 magnetically retain holder 10 on the ferrous metal support.

Returning to FIGS. 5 and 6, a flat pad 42 of plastic or rubber-like material is secured with an adhesive to the bottom of bottom wall 18 of body 11. Pad 42 has a center hole 43 axially aligned with holes 19, 33 and 38. Other types of pads and support can be secured to the bottom wall 18.

There has been shown and described an embodiment of a holder for a can or bottle having a magnetic base to retain the holder on a ferrous metal support. Changes in the holder and magnetic base can be made by persons skilled in the art without departing from the invention defined in the following claims.

The invention claimed is:

1. A thermal insulated holder for accommodating a container comprising:

a cup-shaped body, said body including a cylindrical outside wall, a cylindrical inside wall concentric with and spaced inwardly from the outside wall, a circular bottom wall joined to said inside and outside walls, said bottom wall having a top surface, said inside wall and bottom wall top surface surrounding a chamber having an open top end, a cylindrical core of thermal insulation material located within said chamber, said core having an outside cylindrical surface located in circumferential contact with the inside wall of the body, and inside ribs adapted to engage a container located within the chamber, a base having magnet properties located in the chamber engageable with the top surface of the bottom wall of the body, said base having cup-shaped ferrous metal member having a top wall with a bottom surface and a downwardly directed continuous annular side wall joined to the top wall, said annular side wall having an annular bottom edge located in a generally horizontal plane, said bottom edge of the side wall of the cup-shaped ferrous metal member being located in engagement with the top surface of the bottom wall of the body, and a magnet mounted on the bottom surface of the top wall of the cup-shaped ferrous metal member, said magnet having a bottom surface located above the horizontal plane of the annular bottom edge of the annular side wall of the cup-shaped ferrous metal member whereby magnetic force at the bottom edge of the side wall of the ferrous metal ferrous metal member retains the base on the bottom wall of the body and the holder on a magnetic metal support.

2. The thermal insulated holder of claim 1 including:

a plurality of annular ribs joined to and extended around the cylindrical outside wall of the body.

3. The thermal insulated holder of claim 1 including:

a pad attached to the bottom wall of the body.

4. The thermal insulated holder of claim 1 including:

vertically aligned holes in the bottom wall, magnet and pad open to the chamber of the body.

5. The thermal insulated holder of claim 1 wherein:

the inside ribs comprise vertical ribs circumferentially located on the inside of the cylindrical core.

6. The thermal insulated holder of claim 1 wherein:

the magnet is a permanent magnet.

7. The thermal insulated holder of claim 1 wherein:

the annular side wall of the base is located in engagement with a lower portion of the ribs of the core.

8. The thermal insulated holder of claim 1 wherein:

the body is a stainless steel member.

9. The holder of claim 1 including:

an adhesive attaching the base to the top surface of the bottom wall of the body.

10. A thermal insulated holder for accommodating a container comprising:

a body having a bottom wall and an internal chamber with a bottom and an open top, said bottom wall having a top surface at the bottom of the internal chamber and a bottom surface, a core of thermal insulation material located within said chamber, a base having magnetic properties located within said chamber, said base including a ferrous metal member located in the chamber of the body, said ferrous metal member having a top wall with a bottom surface and a downwardly directed side wall with a bottom edge located in a generally horizontal plane, and a magnet mounted on the bottom surface of the top wall of the ferrous metal member whereby the magnetic force of the magnet is adapted to retain the base on the bottom wall of the body and the holder on a magnetic metal support.

11. The thermal insulated holder of claim 10 including:

a plurality of annular ribs on the body.

12. The thermal insulated holder of claim 10 including:

a pad attached to the bottom wall of the body.

13. The thermal insulated holder of claim 10 including:

a plurality of inside vertical ribs circumferentially located on the inside of the core.

14. The thermal insulated holder of claim 10 wherein:

the magnet is a permanent ring magnet.

15. The thermal insulated holder of claim 10 wherein:

the side wall of the base is located in engagement with a lower portion of the core.

16. A holder for accommodating a container comprising:

a body having an internal chamber with a bottom and an open top and a bottom wall, said bottom wall having a top surface located at the bottom of the chamber and a bottom surface, a base having magnetic properties located within the internal chamber engageable with the top surface of the bottom wall of the body for retaining the holder on a magnetic metal support, said base including a ferrous metal member located in the chamber of the body, said ferrous metal member having a top wall with a bottom surface and a downwardly directed side wall with a bottom edge located in a generally horizontal plane, and a magnet mounted on the bottom surface of the top wall of the ferrous metal member whereby the magnetic force of the magnet is adapted to retain the base on the bottom wall of the body and the holder on a metal support.

17. The holder of claim 16 wherein:

the magnet is a permanent ring magnet.

18. The holder of claim 16 including:

a pad attached to the bottom wall of the body.

19. The holder of claim 16 including:

a cylindrical core located within the internal chamber of the body, said core having an inside wall adapted to engage a beverage can or bottle.

20. The holder of claim 16 including:

an adhesive attaching the base to the top surface of the bottom wall of the body.

* * * * *